US008814727B2

(12) United States Patent
Ramcharan

(10) Patent No.: US 8,814,727 B2
(45) Date of Patent: Aug. 26, 2014

(54) BASEBALL TRAINING DEVICE FOR PRACTICING HITTING

(71) Applicant: Krishna Ramcharan, Toronto (CA)

(72) Inventor: Krishna Ramcharan, Toronto (CA)

( * ) Notice: Subject to any disclaimer, the term of this patent is extended or adjusted under 35 U.S.C. 154(b) by 83 days.

(21) Appl. No.: 13/732,433

(22) Filed: Jan. 1, 2013

(65) Prior Publication Data

US 2014/0187358 A1 Jul. 3, 2014

(51) Int. Cl.
*A63B 69/00* (2006.01)

(52) U.S. Cl.
CPC ..... *A63B 69/0002* (2013.01)
USPC ..... 473/417; 473/423

(58) Field of Classification Search
USPC ..... 473/423–431, 417, 139–147, 451; 482/102
See application file for complete search history.

(56) References Cited

U.S. PATENT DOCUMENTS

| | | | | | |
|---|---|---|---|---|---|
| 722,220 | A * | 3/1903 | Finney | 463/47.1 |
| 3,717,342 | A * | 2/1973 | Haney et al. | 473/430 |
| 4,378,944 | A * | 4/1983 | Johnston | 273/393 |
| 4,993,708 | A * | 2/1991 | Prossor et al. | 473/417 |
| 5,035,424 | A * | 7/1991 | Liao | 473/423 |
| 5,386,988 | A * | 2/1995 | Sung et al. | 473/423 |
| 5,467,979 | A * | 11/1995 | Zarate | 473/429 |
| 5,634,872 | A * | 6/1997 | Brown et al. | 473/430 |
| 5,738,616 | A * | 4/1998 | Robertson | 482/102 |
| 6,398,671 | B1 * | 6/2002 | Rios | 473/417 |
| 6,551,204 | B1 * | 4/2003 | Di Re | 473/417 |
| 7,749,142 | B2 * | 7/2010 | Kuhagen | 482/129 |
| 8,246,493 | B1 * | 8/2012 | Ling | 473/417 |
| 2006/0035729 | A1 * | 2/2006 | Wang | 473/417 |
| 2006/0258485 | A1 * | 11/2006 | Bandimere et al. | 473/417 |
| 2007/0042841 | A1 * | 2/2007 | Suissa | 473/423 |
| 2008/0102990 | A1 * | 5/2008 | Cramer | 473/417 |
| 2011/0319200 | A1 * | 12/2011 | Ramcharan | 473/417 |
| 2012/0225740 | A1 * | 9/2012 | Gibadlo | 473/423 |
| 2013/0178314 | A1 * | 7/2013 | Raimonda | 473/423 |
| 2013/0274074 | A1 * | 10/2013 | Ghandour | 482/93 |

* cited by examiner

*Primary Examiner* — Mark Graham
(74) *Attorney, Agent, or Firm* — Nasser Ashgriz

(57) ABSTRACT

This present invention is a baseball training device for practicing hitting, comprising a swing member supporting either a ball member or a weighted ball member comprising a ball member attached to a weighted member by an elastic member. The swing member, supported by a base member, is restored to its equilibrium position in hitting practice mode by gravity. As the weighted member is always suspended in air in hitting practice mode, its tension restores its ball member to its equilibrium position. The oscillation of the swing member aids in the dissipation of force imparted to the device in hitting practice mode, making the device stable and stationary, portable and lightweight.

12 Claims, 5 Drawing Sheets

BASEBALL TRAINING DEVICE FOR PRACTICING HITTING

BACKGROUND OF THE INVENTION

1. Field of the Invention

There are many types of baseball training devices with which practicing hitting involves hitting a ball with extreme force. The present invention is one of them.

2. Description of Prior Art

Any discussion of the prior art throughout the specification should in no way be considered an admission that such prior art is widely known or forms part of common general knowledge in the field. With baseball, beginners seek to learn to swing; non-beginners strive to perfect their swings. For beginners, it is very desired if they can maximise the number of swings in a given period of time. For serious players, they would like to maintain their swings. When practicing hitting with a training device, some players prefer to have the ball attached to the device; others prefer not to so as to see the trajectory the ball will take after it is hit. Many baseball training devices for practicing hitting have been developed over the years. Baseball prior art relevant to the present invention are U.S. Pat. No. 3,994,494 to Kelly; U.S. Pat. No. 4,966,367 to Oyarzabal; U.S. Pat. No. 6,099,419 to Incaudo et al; U.S. Pat. No. 6,296,582 to Minniear; U.S. Pat. No. 6,306,050 to Holder; U.S. Pat. No. 1,962,087 to Cone; U.S. Pat. No. 5,618,039 to Tsai et al. The commonality of the present invention with a sub-set of prior art is they seek to allow the player to practice in a small space. The commonality of the present invention with another sub-set of prior art is they seek to allow the player to see the trajectory of the ball after it is hit. The present invention diverges from such prior art most importantly in the way it deals with the force imparted to the device when the ball is hit.

BRIEF SUMMARY OF THE INVENTION

One of the objectives of the present invention is to provide a baseball training device for practicing hitting without the need for a net.

Another objective of the present invention is to provide a baseball training device that is lightweight and portable and can withstand the extreme force applied when practicing hitting.

Another objective of the present invention is to provide a baseball training device that can be used equally indoors and outdoors, by both right handed and left handed players, for practicing hitting.

Another objective of the present invention is for it to be used as a Tee.

Another objective of the present invention is for it to be used to practice a level swing.

The design of the present invention achieves these objectives by incorporating a number of features not found in prior art, namely having a swing member and a weighted ball member comprising of a ball member attached to a weighted member by an elastic member. With prior art, when the ball member is hit, force is imparted to the device forcing it to move forward, upward or downward, and sideways. To minimise or prevent such movement, prior art devices have been made heavy and/or staked to the ground. To minimise forward and upward or downward movement of the base member of the present device, the base member supports the swing member which supports the weighted ball member. When the ball member of the weighted ball member is hit, the swing member oscillates, allowing the base member to be substantially stationary. Secondly, when the ball member is hit, it is the weighted member and not the base member that moves upwards. In a second configuration, the swing member freely supports a ball member as in a traditional Tee. When the ball member is hit, it flies off leaving the device stationary. However, if the swing member itself is hit it oscillates preventing the collapse of the device as in traditional Tees.

Furthermore, the aim of this application is to illustrate the preferred embodiments of this baseball training device used to practice hitting.

DESCRIPTION OF THE DRAWINGS

Referring to the attached drawings which form part of this original disclosure.

DETAILED DESCRIPTION OF THE INVENTION

Figure 1A:
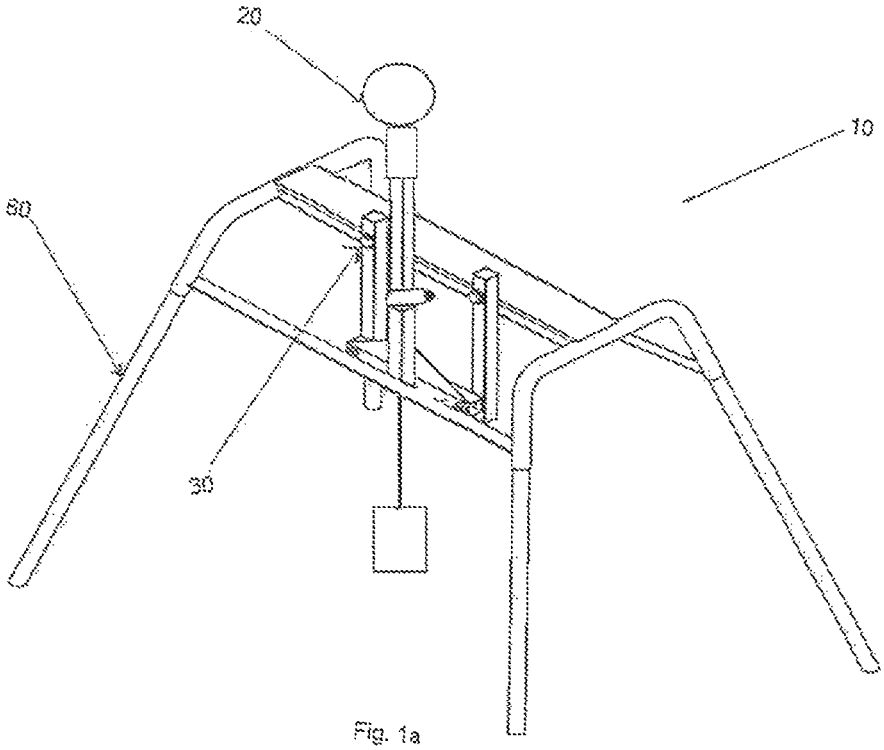
FIG. 1*a* is a Perspective view of the components that comprise the preferred embodiment of the present invention.
Figure 1B:
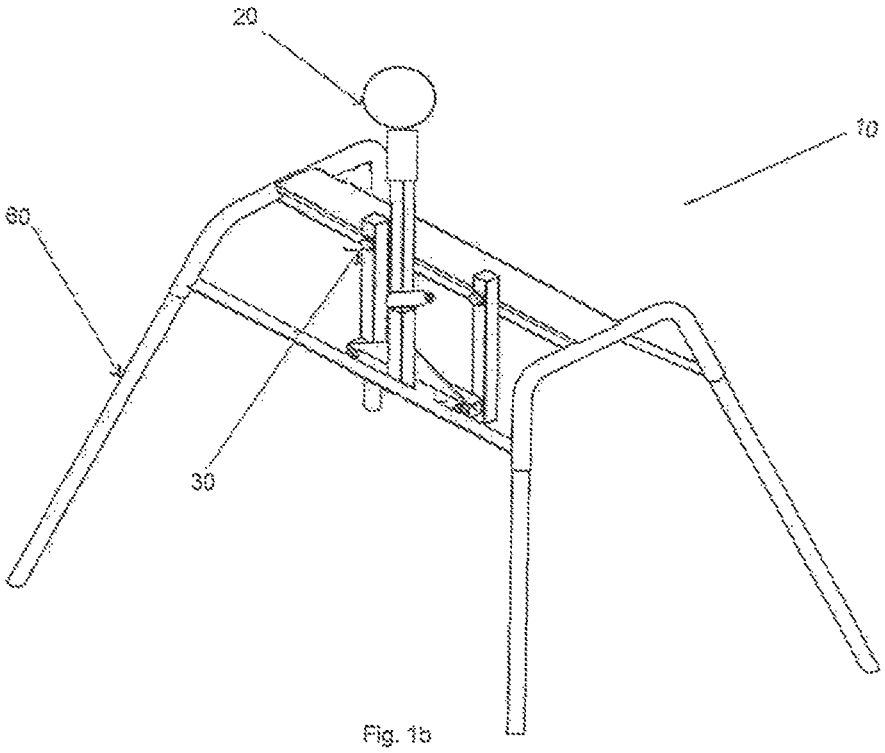
FIG. 1*b* is a Perspective view of the components that comprise a second embodiment of the present invention.

Referring to FIG. 1*a*, therein is shown in hitting practice mode, a Perspective view of the preferred embodiment of the baseball training device 10 for practicing hitting, the baseball training device 10 comprising of a weighted ball member 20 mounted on a swing member 30, which is supported by a base member 60; referring to FIG. 1*b*, therein is shown in hitting practice mode, a Perspective view of a second embodiment of the baseball training device 10 for practicing hitting, the baseball training device 10 comprising of a ball member 20 mounted on a swing member 30, which is supported by a base member 60.

Figure 2A:
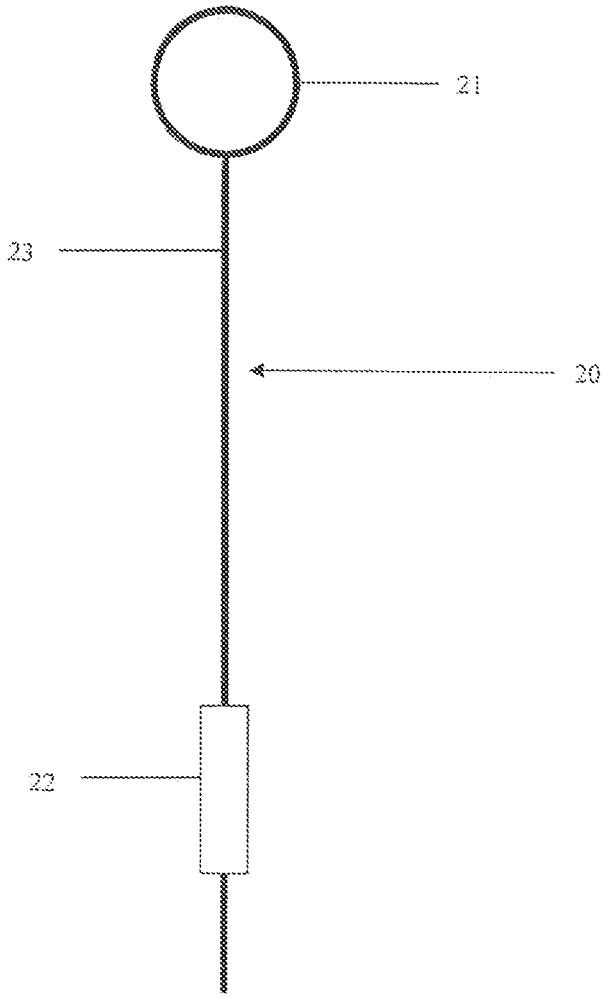
FIG. 2*a* is a Perspective view of the embodiment of the weighted ball member.
Figure 2B:
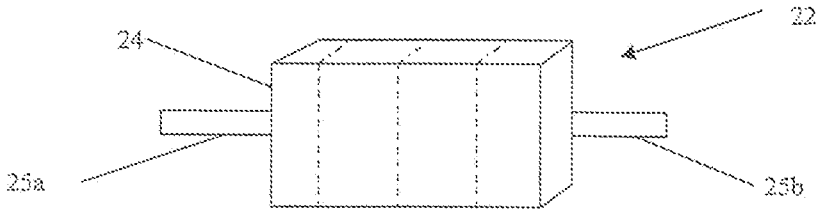
FIG. 2*b* is a Perspective view of the embodiment of the weighted member.

Referring to FIG. 2*a*, therein is shown the Perspective view of the preferred embodiment of the weighted ball member 20 comprising of a ball member 21 connected to a weighted member 22 by an elastic member 23; referring to FIG. 2*b*, therein is shown the Perspective view of the embodiment of the weighted member 22 comprising of a flexible weight 24 attached to Velcro straps 25*a* and 25*b* which allow the weight 24 to be attached to the elastic member 23.

Figure 3A:
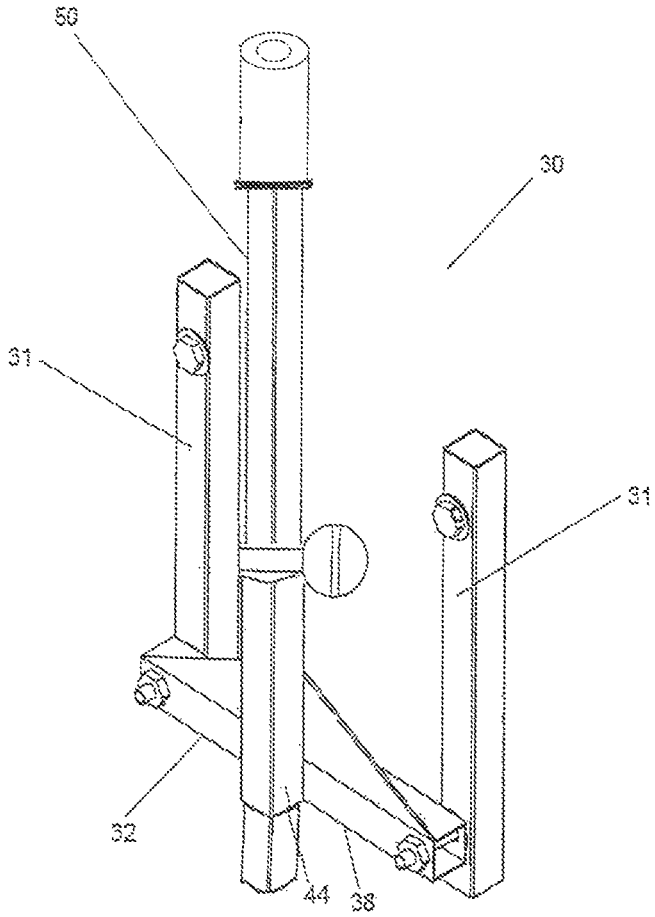
FIG. 3*a* is a Perspective view of the preferred embodiment of the swing member.
Figure 3B:
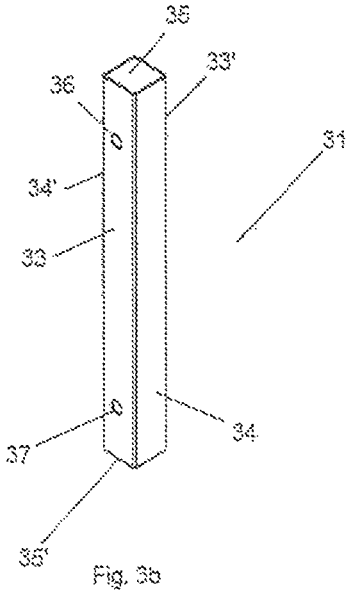
FIG. 3*b* is a Perspective view of the preferred embodiment of one of the plurality of the suspension member.
Figure 3C:
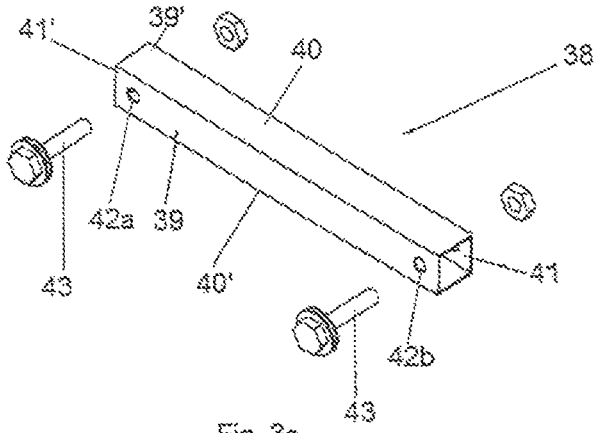
FIG. 3*c* is a Perspective view of the preferred embodiment of the cradle member of the shoulder member.
Figure 3D:
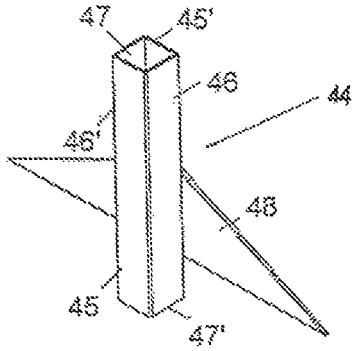
FIG. 3*d* is a Perspective view of the preferred embodiment of the receptacle member of the shoulder member.
Figure 3E:
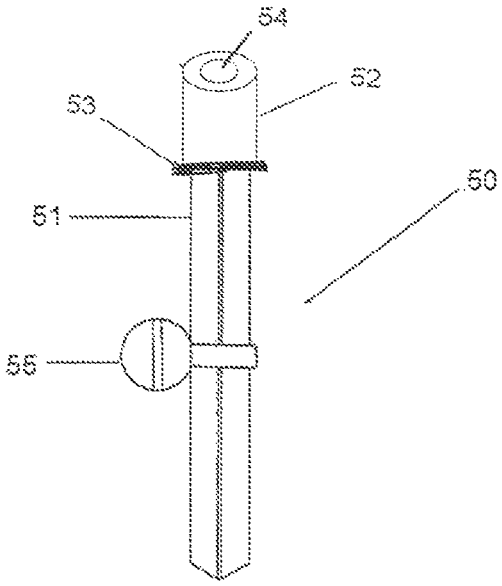
FIG. 3*e* is a Perspective view of the preferred embodiment of the tower member.
Figure 3F:
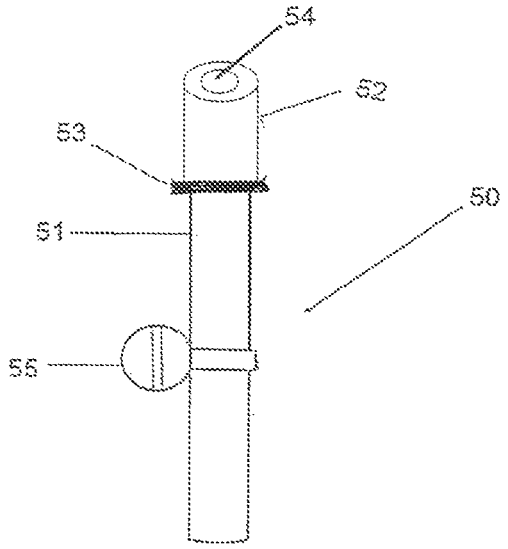
FIG. 3*f* is a Perspective view of the second embodiment of the tower member.

Referring to FIG. 3*a*, therein is shown the Perspective view of the preferred embodiment of the swing member 30. The swing member 30 is comprised of a plurality of suspension members 31 rotatably connected to a shoulder member 32 comprising of a cradle member 38 at the centre of which is a receptacle member 44 for receiving a tower member 50 which supports the weighted ball member 20. As shown in FIG. 3*b*, the preferred embodiment of each of the suspension member 31 is rigid and has a front and back longitudinal face 33 and 33', and a first and a second lateral face 34 and 34', and an upper face 35 and a lower face 35'. The front and back longitudinal faces 33 and 33' are parallel to each other. The hole 36 thru and perpendicular to the front and back longitudinal faces 33 and 33' and located in the proximity of the upper face 35 of each of the suspension member 31 allows for each of the suspension member 31 to be rotatably connected to the base member 60. The hole 37 thru and perpendicular to the front and back longitudinal faces 33 and 33' and located in the proximity of the lower face 35' of each of the suspension member 31 allows for each of the suspension member 31 to be rotatably connected to the shoulder member 32. The holes 36 and 37 are mirror images of each other. Referring to FIG. 3*c*, therein is shown the Perspective view of the cradle member 38 of the shoulder member 32 of the preferred embodiment of the swing member 30. The cradle member 38 has a front and back longitudinal face 39 and 39', and an upper and a lower lateral face 40 and 40', and side faces 41 and 41'. The front and back longitudinal face 39 and 39' faces are parallel to each other. 42*a* and 42*b* are holes located in the proximity of the side faces 41' and 41, thru and perpendicular to the front and back longitudinal faces 39 and 39'. The holes 42*a* and 42*b* are mirror images of each other. Thru the holes 42*a* and 42*b* fasteners 43 attach the cradle member 38 to the suspension members 31 with the front longitudinal face 33 of the suspension member 31 contiguous to back longitudinal face 39' of the cradle member 38, with each of the holes 37 aligned with the holes 42*a* and 42*b*. As shown in FIG. 3*d*, the preferred embodiment of the receptacle member 44 has a front and a back longitudinal face 45 and 45', and side lateral faces 46 and 46', and an upper opening 47 and a lower opening 47'. The front and back longitudinal faces 45 and 45' are parallel to each other as are the side lateral faces 46 and 46'. A gusset plate 48, forming part of the back longitudinal face 45', is affixed to the upper lateral face 40 of the cradle member 38. The receptacle member 44 is perpendicular to the cradle member 38, with its back longitudinal face 45' affixed to the front longitudinal face 39 of the cradle member 38 from the lower lateral face 40' to the upper lateral face 40. Referring to FIG. 3*e*, therein is shown the Perspective view of the preferred embodiment of the tower member 50 which is comprised of a tubing member 51 whose cross section is non-circular. At the upper end of tubing member 51 is a detachable ball holder 52. A stopper member 53 is affixed to the tubing member 51 preventing the detachable ball holder 52 from sliding down the tubing member 51. In hitting practice mode the ball member 21 of the weighted member 20 is mounted on the ball holder member 52 with the elastic member 23 of the weighted member 20 passing thru the channel 54 of the ball holder member and thru the tubing member 51. Referring to FIG. 3*f*, therein is shown the Perspective view of the second embodiment of the tower member 50 which is comprised of a tubing member 51 whose cross section is circular. At the upper end of tubing member 51 is a detachable ball holder 52. A stopper member 53 is affixed to the tubing member 51 preventing the detachable ball holder 52 from sliding down the tubing member 51. In hitting practice mode the ball member 21 of the weighted member 20 is mounted on the ball holder member 52 with the elastic member 23 of the weighted member 20 passing thru the channel 54 of the ball holder member and thru the tubing member 51. 55 is a locking member around the tubing member 51. In both embodiments, the height of the ball member 21 is adjusted by unlocking the locking member 55, sliding the shaft member 51 within the receptacle member 44, then tightening the locking member 55 which then sits on the upper opening 47 of the receptacle member 44.

Figure 4:
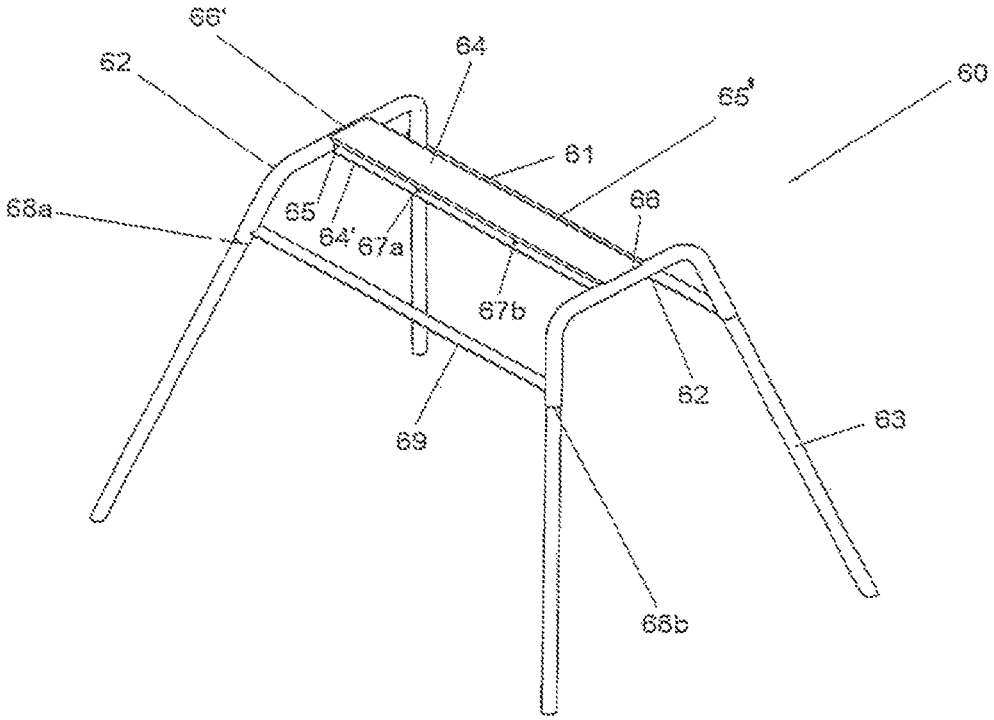
FIG. 4 is a Perspective view of the preferred embodiment of the base member.

Referring to FIG. 4, therein is shown the Perspective view of the preferred embodiment of the base member 60 comprising of a bridge member 61, a plurality of arch members 62 and a plurality of legs 63 of substantially the same length detachable from said arch members 62. The bridge member 61 has a top and bottom longitudinal face 64 and 64', a front and back lateral face 65 and 65', and side faces 66 and 66'. Each of the plurality of arch members 62 is affixed to a side face of the bridge member 61 in a mirror image of each other, at an obtuse angle to the bottom longitudinal face 64' of the bridge member 61. The bridge member 61 is in an off-centre position relative to the centres of the arch members 62. The swing member 30 is supported in a position substantially centred to the centres of the arch members 62 by fasteners 67*a* and 67*b* thru and perpendicular to the front lateral face 65 of the bridge member 61 and thru the hole 36 of each of the suspension members 31. The position of the fasteners 67*a* and 67*b* are mirror images of each other relative to the centre of the bridge member 61. The spacing between the fasteners 67*a* and 67*b* of the bridge member bland fasteners 42*a* and 42*b* of the cradle member 38 are the substantially the same. Each of the plurality of arch members 62 has open ends 68*a* and 68*b*. Into the open ends 68*a* and 68*b* of the arch members 61 are inserted the plurality of legs 63 in hitting practice mode. Parallel to and on each side of the bridge member 61 strut members 69 are affixed to the arch members 62, substantially close to the open ends of the arch member 62.

A suitable material for the ball member 21 to be made of is polyurethane which has rubber-like properties. However, it can be an actual baseball. The suspension members 31 are made of a hard plastic such as UHMW or nylon. The locking member 55 is a worm gear clamp. The rest of the device is constructed of metal and the preferred manner of affixing the parts permanently is welding.

This invention has been disclosed and described in its preferred embodiment with a certain degree of peculiarity; it is understood that the present disclosure of the preferred embodiment is only by way of example and that numerous changes in the details and arrangements of parts may be resorted to without departing from the spirit and scope of the invention as hereinafter claimed.

What is claimed is:

1. A baseball training device for practicing hitting, comprising:

a. a weighted ball member comprising of a ball member attached to a weighted member by an elastic member, said weighted member of said weighted ball member always suspended in air in hitting practice mode, with such suspension always creating tension in said elastic member of said weighted ball member;

b. a swing member supporting said weighted ball member in hitting practice mode; and c. a base member supporting said swing member.

2. The baseball training device for practicing hitting of claim 1, wherein said weighted member of said weighted ball member is detachable from said elastic member of said weighted ball member.

3. The baseball training device for practicing hitting of claim 1, wherein said swing member is comprised of:

a. a tower member comprising a detachable ball holder member mounted on a tubing member around which is a locking member;

b. a shoulder member having a receptacle for receiving said tower member; and d. a plurality of rigid suspension members of substantially the same length, rotatably connected to said shoulder member and said base member.

4. The baseball training device for practicing hitting of claim 3, wherein said tower member is detachable from said receptacle member of said shoulder member.

5. The baseball training device for practicing hitting of claim 3, wherein said tower member is rotatable completely, clockwise and counter-clockwise, within said receptacle member of said shoulder member.

6. The baseball training device for practicing hitting of claim 3, wherein in hitting practice mode said ball member of said weighted ball member rests on said detachable ball holder member, with said elastic member of said weighted ball member passing thru said detachable ball holder and said tubing member.

7. The baseball training device for practicing hitting of claim 6, wherein, at desired height of said ball member of said weighted ball member, said locking member is locked and rests on said receptacle of said shoulder member allowing said tower member to move substantially vertical within said receptacle.

8. The baseball training device for practicing hitting of claim 3, wherein said rotation of said plurality of rigid suspension members is synchronized, with the centre of rotation of each of said plurality of suspension members being its connection to said base member.

9. The baseball training device for practicing hitting of claim 3, wherein in their equilibrium positions in hitting practice mode said plurality of rigid suspension members is substantially vertical, said shoulder member is substantially horizontal and said tower member is substantially vertical.

10. The baseball training device for practicing hitting of claim 9, wherein said plurality of rigid suspension members, said shoulder member and said tower member are restored to their equilibrium positions in hitting practice mode by gravity.

11. The baseball training device for practicing hitting of claim 1, wherein said base member is comprised of:

a. a plurality of arch members connected by a bridge member; and b. a plurality of legs of substantially the same length connected detachably to said arch members.

12. The baseball training device for practicing hitting of claim 11, wherein said bridge member is connected to said plurality of arch members in an off-centred configuration.

* * * * *